United States Patent [19]

Muskovin et al.

[11] 4,402,427

[45] Sep. 6, 1983

[54] CARTRIDGE PISTON WITH INTEGRALLY MOLDED SEALING PLUG

[75] Inventors: Alfred J. Muskovin, Greensboro, N.C.; Paul J. Green; Lawrence J. Aubert, both of Cincinnati, Ohio

[73] Assignee: The Procter & Gamble Company, Cincinnati, Ohio

[21] Appl. No.: 286,096

[22] Filed: Jul. 22, 1981

[51] Int. Cl.[3] ..... B67D 5/22

[52] U.S. Cl. ..... 222/47; 222/481; 222/386

[58] Field of Search ..... 222/478, 481, 47, 386, 222/41, 23; 141/18; 137/68 R; 220/86 NR

[56] References Cited

U.S. PATENT DOCUMENTS

| | | | |
|---|---|---|---|
| Re. 26,012 | 5/1966 | Green | 222/394 |
| 2,085,446 | 6/1937 | Philippe | 222/386 |
| 2,371,332 | 3/1945 | Jacobson | 222/386 |
| 2,900,850 | 7/1960 | Bastian | 76/31 |
| 2,952,278 | 9/1960 | Waldherr | 141/20 |
| 3,057,647 | 10/1962 | Wood | 287/110 |
| 3,664,508 | 5/1972 | Linder | 222/386 |
| 4,167,245 | 9/1979 | Kock et al. | 222/391 X |
| 4,231,486 | 11/1980 | Bock | 220/266 |

*Primary Examiner*—Joseph J. Rolla
*Assistant Examiner*—Thomas C. Fitzgerald
*Attorney, Agent, or Firm*—John V. Gorman; Richard C. Witte; Thomas H. O'Flaherty

[57] ABSTRACT

A dispensing cartridge or other similar container having a piston-type closure at one end and an apertured dispensing wall at its other end which may be covered by a cover or cap. The piston-type closure is a rigid structure which includes a sealing ring to engage the container sidewall, a centrally-located filling aperture and a integrally-molded, detachable plug that is aligned to the aperture and adapted to be forced into the aperture to close and seal the container after filling. The plug is attached to the piston closure by several frangible elements and the container is filled via the gaps formed between these elements.

11 Claims, 5 Drawing Figures

CARTRIDGE PISTON WITH INTEGRALLY MOLDED SEALING PLUG

TECHNICAL FIELD

The present invention relates to container closures and, more particularly, to packages including molded piston-type closures which include a filling inlet and an integrally molded plug which is adapted to seal said inlet.

BACKGROUND ART

There is a wide variety of closures disclosed in the prior art covering many different concepts. However, the conventional prior art closure is designed to be assembled to a container after the container is filled. To provide for a closure that can be assembled to the container before it is filled and yet still allow for filling, requirs that the closure or container include means to communicate with the package interior and a means for sealing the closure or container after the filling operation is completed.

Also, in production, the conventional closure involves a two-step filling operation requiring one step for filling and another for assembling the closure to the container opening after filling. For most filling applications this two-step filling and closing operation is satisfactory although not always very efficient, and it is vulnerable to the accidental introduction of extraneous matter into the container between the filling station and the closing station. The more desirable type of closure would somehow enable one to combine the filling and closing operations into a single operation.

One solution to this problem is to provide a closure having a filling inlet and a sealing plug, integrally connected to the closure which can be placed into the filling inlet immediately after filling. This approach is used in U.S. Pat. No. 2,952,278 issued on Sept. 13, 1960 to W. Waldherr which discloses a spray head and filling plug. The spray head, in the embodiment shown in FIGS. 1–6, is designed to be mounted on a container and includes a plug which is integrally molded with the spray head. The plug is initially driven part way into the bore of the spray head, blocking off the spray discharge passageway. The plug has a lateral hole that communicates with an axial inlet passageway that is located just above the container inlet. The container can be filled via this lateral hole and when the filling is completed and while the spray head is vertically supported by the valve cup wall, the plug can be driven full depth into the spray head, until the lateral hole in the plug is aligned with a spray discharge passageway. Another embodiment of the spray head, shown in FIGS. 7 and 8, provides for a series of integrally molded fins that project inwardly from the edges of a filling inlet communicating with the container inlet and which are joined to a centrally-located plug. The container to which the spray head is attached is filled via the gaps between the several fins and the plug and the inlet. After the filling operation is completed and, again, while the spray head is fully supported by the valve cup, the plug is driven into the valve stem upper end to seal it.

Each of the described Waldherr embodiments rely on structural means fully supporting the part bearing the plug seal at the time of closure. There is no teaching as to how such a filling concept could be accomplished using a package or equipment with which structural support is not present, e.g. where the integral plug is part of a molded piston-type closure.

According it is an object of the present invention to provide a closure means having a filling aperture that is closed and sealed by a plug in which the closure has no structural means to support it while the plug is being inserted into the aperture during sealing.

It is also an object of this invention to provide an economical closure means capable of allowing a piston actuated container to be filled and sealed in one operation.

Another object of the invention is to provide a one-piece piston-type closure having an integrally molded, detachable element for sealing the filling inlet in the closure.

Yet another object of the invention is to provide a container having a piston-type closure that is capable of withstanding repeated impact loads for the purpose of forcing a semi-liquid, viscous material through a plurality of dispensing outlets in the container.

Still another object of the invention is to provide a closure device that includes a means for signaling that the material in the container has been exhausted.

DISCLOSURE OF THE INVENTION

This invention provides for a cartridge comprising a container having a cylindrical sidewall with a circular top wall affixed thereto and a plurality of dispensing outlets through the top wall. The cartridge also includes a generally rigid, disc-shaped, piston-type lower closure that is telescoped within the container sidewall and includes an annular sealing member around the periphery of its upper side in sealing engagement with the container sidewall, an aperture extending axially therethrough and a cylindrical sidewall. The closure also includes an integrally molded, detachable plug depending from its lower side and aligned with the aperture and the plug is fixed in a generally spaced relation with the adjacent lower end of the aperture such that there is provided a gap therebetween for use as a filling passageway. The plug is sized and shaped for insertion into the aperture to close and seal the container after the container is filled.

BRIEF DESCRIPTION OF THE DRAWINGS

Further objects and advantages of the invention will become apparent from the following description and claims, and from the accompanying drawings, wherein:

DETAILED DESCRIPTION OF THE INVENTION

Figure 1:
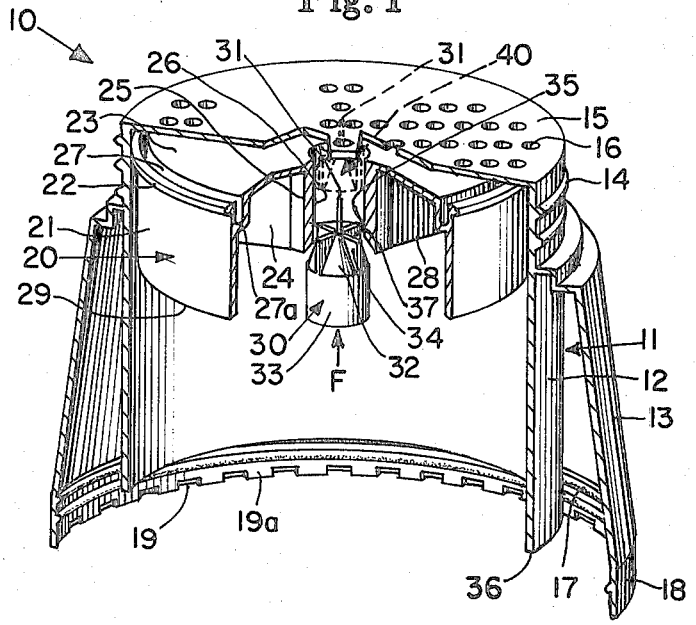
FIG. 1 is a perspective view, partially broken away, of one embodiment of the present invention in which a piston-type closure is assembled into a dispensing cartridge to close the bottom opening thereof.
Figure 2:
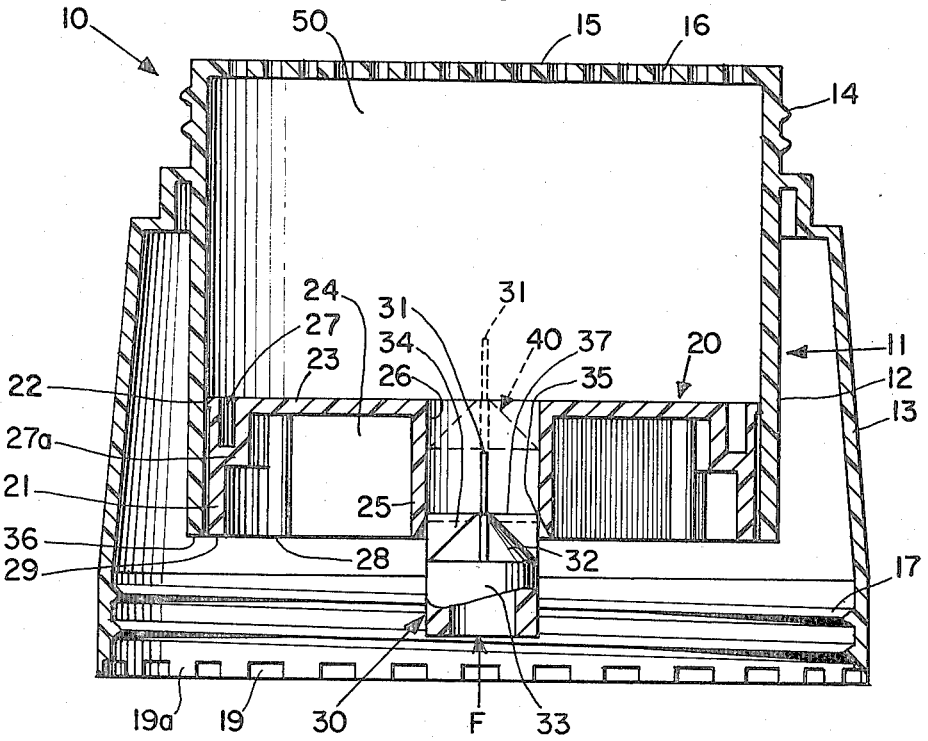
FIG. 2 is an enlarged vertical cross-sectional view of the filled dispensing cartridge of FIG. 1, with the piston-type closure in its lowermost position prior to sealing.

Referring now to the drawings in detail, wherein like numerals indicate like elements throughout the several views, the present invention is shown in two particular embodiments although there are a number of other potential embodiments. In FIG. 1 there is shown in perspective a dispensing cartridge 10, all parts of which are preferably made of polypropylene, comprising a container 11 surrounded by a depending, integrally formed skirt 13. The container 11 is of inverted cup-shape form, having a generally cylindrical sidewall 12 and apertured top wall 15. Within the container 11 interior is a piston-type closure 20 which is disc shaped and has an integrally connected sealing plug 30 depending therefrom in direct alignment with an axially extending aperture 26. As shown in solid object lines, the piston closure 20 is assembled into the container 11 and the position it would occupy just prior to filling the container 11. FIG. 2 shows the same dispensing cartridge 10 in cross-section, with the piston closure 20 in the position it would occupy after the dispensing cartridge 10 is filled with a product or material 50. Material 50 is preferably of semi-liquid form and suitable for spraying in the manner described in U.S. Pat. No. 4,167,245, issued Sept. 11, 1979 R. W. Koch et al., e.g. generally thick and viscous with little tendency to run or flow by gravity.

The top wall 15 includes a series of dispensing outlet holes 16 arranged in a pattern designed to handle the dispensing of the particular material 50 to be packaged in the cartridge 10, in accordance with the teachings of the aforesaid Koch et al. patent. The pattern and dimensions of holes 16 can be varied to accommodate the viscosity of the material 50 packaged in the catridge 10 and the desired spray pattern. For example, for a material 50 that is an anhydrous antiperspirant cream of the type described in U.S. Pat. No. 4,083,956, issued Apr. 11, 1978 to D. L. Shelton, hereby incorporated by reference herein, where the viscosity is approximately about 25 to about 50 centipoise it has been found desirable to have 139 holes 16 of 0.66 to 0.81 mm. diameter uniformly spaced on the top wall 15 of a container 11 having a diameter of about 4.76 cm.

The threads 14 shown near the upper edge of the outer surface of the side wall 12 are provided for connecting a top cover or cap (not shown) to the container 11 when the cartridge is not in use. The threads 14 illustrate just one means for applying a top cover or cap to the container 11 and any number of other, alternative connecting means, known to those skilled in the art, would be equally appropriate. The top cover or cap may also include a sealing means to engage the top wall 15 of the container to prevent loss of material 50.

The skirt 13 which is integrally attached to and surrounds the container 11 is provided with threads 17, located near the lower edge of the interior of the skirt 13. Threads 17 are adapted to connect the dispensing cartridge 10 with a dispensing mechanism, not shown, as hereinafter described. As before, the use of threads is only one possible means for connecting the cartridge 10 to the dispensing mechanism and other means could be equally suitable.

Other useful structural aspects could also be incorporated into the design of the cartridge 10. For example, the knurled area 18 on the outer bottom wall of the skirt 13 is intended to provide a high friction grip to assist one in assembling and in removing the dispensing cartridge 10 from assembly with a dispensing mechanism. Another aspect is the provision of a pattern of recesses 19 on the inner bottom wall of the skirt 13 to provide unscrewing lugs 19*a* therebetween to facilitate removal of the molded part (i.e. the container 11 and integral skirt 13) from the mold within which it is formed. These particular examples of useful structural details relate specifically to the embodiment shown in FIG. 1. For other embodiments there would be equally useful structural details that one of ordinary skill in the art could incorporate into the final design for the purpose of enhancing its utility.

Figure 3:
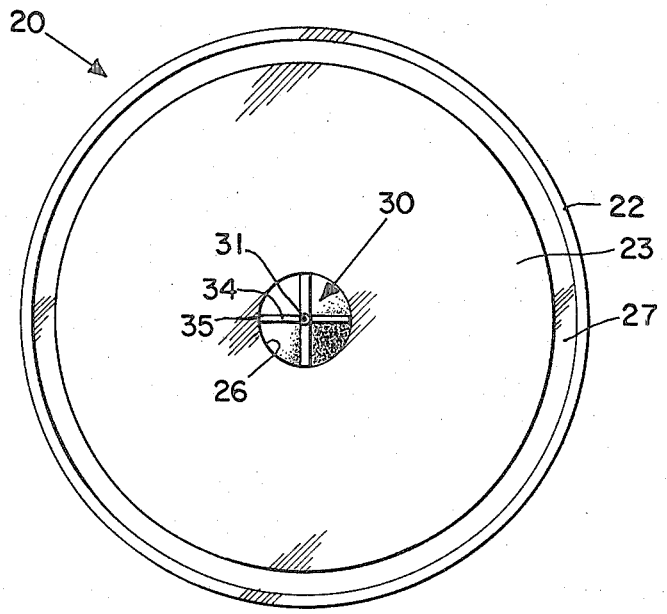
FIG. 3 is a top plan view of the piston-type closure of FIG. 1.
Figure 4:
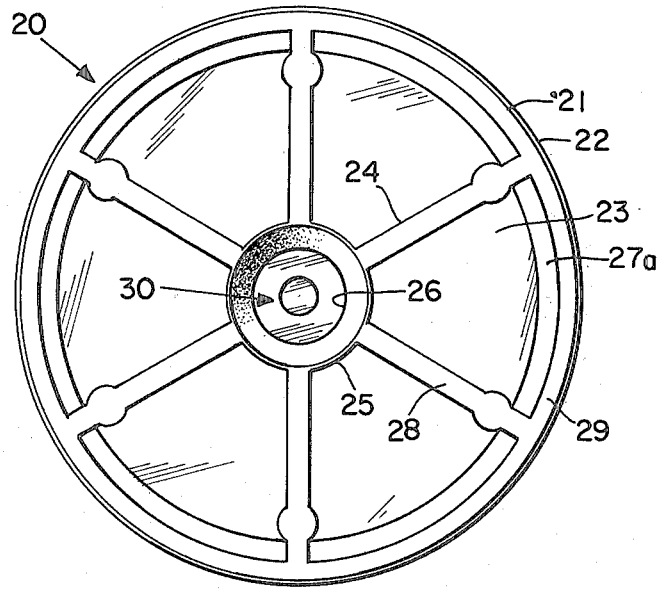
FIG. 4 is a bottom plan view of the piston-type closure of FIG. 1.

The piston-type closure 20, that is telescoped into container 11 in FIGS. 1 and 2 and shown in detail in FIGS. 3 and 4, includes an outer cylindrical side wall 21, having along its upper exterior edge an annular sealing ring 22 having a diameter of about 4.80 cm. and hence an interference of about 0.40 mm. to provide sealing engagement with the inner surface of the side wall 12 of container 11 which has a diameter about 4.76 cm. to prevent leakage of the material 50 to be dispensed. The piston closure 20 also includes a top wall 23, a centrally located hub 25 having an aperture 26 therethrough that is chamfered or tapered to provide a lead-in surface at its lower extremity, radiating structural support members 24 that extend between the hub 25 and the side wall 21 and are attached to the top wall 23, and an integrally connected, molded-in-place plug 30 that is attached near the lowermost end of aperture 26. The top wall 23 has an annular coaxial groove 27 formed therein adjacent its outer periphery, thus leaving the sealing ring 22 cantilevered from the sidewall 21 and spaced from the top wall 23 and the vertical leg of annular stepped section 27*a*, which interconnects the top wall 23 with side wall 21.

It is preferred that the top wall 23 of the closure 20 and the top wall 15 of the container 11 be configured to closely match each other, so that there is as little material 50 therebetween as possible when the closure moves to its final, uppermost, position during use. Thus, the parts could be made to nest or, as shown, comprise mating planar surfaces designed to be closely adjacent when the last dispensing action is complete.

The illustrated embodiment it will be noted, employs six equally-spaced structural support members 24 on closure 20 that are sized such that the lowermost edge 28 of the support members 24 are coplanar with the lowermost edge 29 of the side wall 21. The purpose of the support members 24 is to make the body of closure 20 rigid, without using excess material. Thus, the closure 20 will move as a rigid unit if a force is applied to its lower surfaces.

The plug 30, as shown in FIG. 2, includes a lower section 33 that is generally cylindrical in shape and slightly greater in diameter (e.g. about 0.46 mm.) than the inlet aperture 26, an upper section 32 of generally conical shape and an axially extending cylindrical "flag" or signal element 31 positioned at the apex of the conical shape of the upper section 32 of plug 30. The plug 30 is interconnected with the closure 30 by means of four vane-like frangible or detachable elements 34, the corners 35 of which are located on the inner surface of inlet aperture 26 at a point just beyond the chamfered inlet edge. The elements 34 are designed to be easily detached from the inlet aperture 26 at corners 35 by axially directed forces applied to the plug. Thus, the detachable elements 34 are connected such that they are generally capable of withstanding normal handling forces but will easily detach when struck by a sufficient, upwardly directed force F.

In one preferred embodiment, using polypropylene as the material of construction and four detachable elements 34 each being interconnected (with aperture 26 at corner 35) along their entire width of about 0.102 cm. for a depth of about 0.038 cm., the force required to detach these elements 34 is between about 3 to 6 kg of force. However, the required force can vary considerably depending on the number, size and shape of the elements 34 and may also vary somewhat between similar cartridges 10 depending upon the method of manufacturing and the materials of manufacture. Also the force F may be an impact force and then the force required to detach elements 34 will depend in part on the available length through which the force impacting means can travel.

When the plug 30 is detached and subsequently driven into inlet aperture 26, the flag or signal element 31 is intended to protrude beyond the plane of top wall 23, as shown in phantom lines at position 40 in FIGS. 1 and 2. The illustration of plug position 40 in FIG. 2 shows the position that the plug 30 would occupy after the container 11 is filled with a material 50 and the plug 30 is driven into inlet aperture 26 to seal the cartridge 10. The illustration of position 40 in FIG. 1 shows the position that the plug 30 would occupy after the material 50 in container 11 has been exhausted. It should be noted that flag element 31 is shown, in FIG. 1, protruding through a centrally located hole 16, thereby providing the consumer with a visible indication that material 50 has been exhausted. This centrally located hole 16 may be identical to the other dispensing holes 16 or it may be of a different design. In one embodiment the container 11 is manufactured such that this centrally located hole is larger than the other holes 16 and is covered by flashing. When material 50 is nearly exhausted the flag element 31 is then driven through this flashing by the force impacting means. This design allows one to construct a sufficiently rigid flag element 31 and to have ample clearance between the element 31 and the central hole 16 to ensure that it works properly.

In use, the container 11 is filled with material 50, with a minimum of void volume therein and with the piston-type closure 20 in full contact with material 50 and sealed. This could be accomplished in a conventional approach by placing a measured amount of material 50 in inverted container 11, telescoping the closure 20 within the sidewall 12, drawing a vacuum through inlet aperture 26 as the closure is moved axially into intimate contact with material 50 and then the plug 30 driven into aperture 26 to position 40, as shown in FIG. 2.

In a preferred method, however, the cartriage 10 is initially assembled, i.e., the piston closure 20 is inserted into container 11 and is positioned against the inner surface of top wall 15, as shown in FIG. 1. The assembled cartridge 10 is then engaged with a filling nozzle, not shown, applied to closure 20 over plug 30 and aperture 26. The material 50 is introduced into the container 11 by the filling nozzle via inlet aperture 26 while the nozzle simultaneously pulls a vacuum on the interior of the container 11. There needs to be a sufficient force associated with the injection of material 50 in the filling operation to cause the piston closure 20 to move outwardly within side wall 12 as the material 50 fills the volume between the outer surface of top wall 23 on the piston and the inner surface of top wall 15 in the container. While being filled, the holes 16 should be covered or blocked to prevent discharge of material 50 therethrough. The filling operation continues until the desired quantity of material 50 is within the container 11, at which time the lowermost edge 29 of side wall 21 of piston closure 20 is desirably approximately coplanar with the lowermost edge 36 of sidewall 12. At this point the filling operation ceases and a means for applying a force against the lowermost surface of plug 30 acts in the direction of arrow F to apply a sufficient force to break detachable members 34 free from the inner surface of hub 25 and force the plug 30 into inlet aperture 26 thereby sealing cartridge 10. The plug 30 is driven into inlet aperture 26 to a point where the uppermost edges 37 of detachable members 34 are approximately coplanar with top wall 23 of piston 20.

Because of its structure and, particularly, provision of the groove 27 alongside sealing ring 22 (which permits material 50 to act on the inner surface of the sealing ring), when the hydrostatic pressure within the material 50 of the filled cartridge 10 rises, the sealing ring is pressed against the inner surface of sidewall 12 with greater force to provide greater sealing capability. In addition, because of the rigidity of the closure 20, by reason of the beam action of support members 24, when a force is applied to its lower surfaces the whole closure 20 is biased upwardly, rather than particular portions distorting.

These structural features assure that when the plug 30 is driven into the inlet aperture 26 after filling, the sealed condition of the container 11, the rigidity of the closure 20 and the virtual incompressibility of the material 50 provides sufficient support or backup to assure that the plug 30 will break loose and penetrate aperture 26 to the proper extent. In addition, in operation these features permit inducement of a pressure pulse within the uncovered container 11, when the lower face of the closure 20 is struck a sharp blow, and thus permit spray dispensing of the material 50.

The filled cartridge 10 can be used with any appropriate dispensing mechanism, a variety of which are feasible. Desirably, the dispensing mechanism should move the closure 20 within the sidewall 12 by exerting a substantially uniform force against the lowermost surfaces of piston 20, including the lowermost edges 28 of support members 24 and the lowermost edge 29 of sidewall 21. One preferred dispensing mechanism is the spray dispenser disclosed in U.S. Pat. No. 4,167,245 issued Sept. 11, 1979 to R. W. Kock et al., the disclosures of which patent are hereby incorporated by reference. The filled cartridge 10 of the present invention would be employed in the same manner as the product canister of the Kock et al. patent with appropriate changes to the dispenser to mount the cartridge 10 thereon. The Kock et al. spray dispenser 10 is designed such that it will provide an impact force against the lowermost surface of piston closure 20 of the present invention. Thus, the threads 17 on skirt 13 of the present invention would engage with mating threads on the Kock et al. dispenser to firmly hold the cartridge 10 in proper positon, with the closure 20 directly overlying the impacting means of the dispenser.

Referring to the Kock et al. disclosure and reference numerals, to operate the spray dispenser 16, the consumer depresses trigger 16 which presses slide 80 against compression spring 86 and retracts the hammer 64 into bowl 58. Upon release of trigger 16, slide 80 is propelled against hammer stem 66 causing the hammer stem 66 to move upwardly until impact face 70 strikes the lower face of follower 32 of the attached canister (or, if the cartridge 10 the present invention is mounted on the Kock et al. dispenser, the lowermost surfaces of piston 20) transferring its momentum force to the movable wall or piston and thereby providing a single pressure pulse within the contents of the canister or cartridge.

Figure 5:
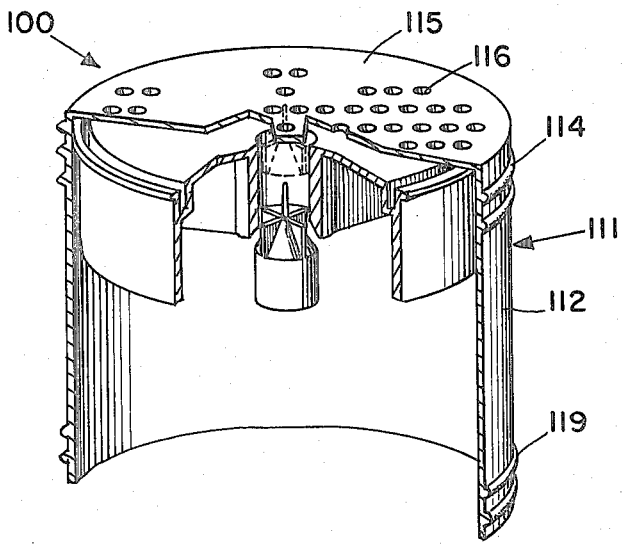
FIG. 5 is a perspective view, partially broken away, of an alternative embodiment of the present invention.

A somewhat modified version of the present invention, shown in FIG. 5 as cartridge 100, could also be mounted on the spray dispenser disclosed in Kock et al. The cartridge 100 differs from cartridge 10 in that there is no skirt 13 surrounding the container 11. Cartridge 100 includes container 111 having cylindrical side wall 112 and top wall 115 having a plurality of dispensing holes 116 therethrough. Threads 114 are provided near the upper edge of the outer surface of side wall 112 for connecting a top cover or cap (not shown) to container 111 and threads. Threads 119 are provided in the lower external surface of container 111 to engage with mating threads on the Kock et al. dispenser to firmly hold the cartridge 100 in the proper position. For aesthetic purposes a shroud similar to the skirt 13 of cartridge 10 could be integrally molded with the Kock et al. dispenser and the final assembly of cartridge 100 with the Kock et al. dispenser would be substantially similar in appearance to the assembly of cartridge 10 with the Kock et al. dispenser. Cartridge 110 also includes the same piston closure 20 as cartridge 10 and can be used with the same material 50. The advantage of cartridge 100 over cartridge 10 is that cartridge 100 is somewhat less expensive to manufacture and therefore provides the consumer with a less expensive replacement cartridge once the product 50 contained in the original cartridge supplied with the dispenser has been exhausted.

The above-described cartridge 10 and cartridge 100 are but two embodiments where an integrally molded-in-place plug can be employed for final sealing and closure of a container immediately after and at the same work station as the filling operation. Various improvements, modifications and alternative applications and uses will be readily apparent to those of ordinary skill in the art. Accordingly, the scope of the present invention should be considered in terms of the following claims and it is not to be limited to the details of the embodiment and its structure and operation, shown in the specification and drawings.

I claim:

1. A cartridge comprising:

(a) a container having a cylindrical sidewall with a circular top wall affixed thereto, said top wall having a plurality of dispensing outlets therethrough;

(b) a generally rigid, disc-shaped, piston-type lower closure having an upper and a lower side, an aperture extending axially therethrough and a cylindrical sidewall;

(c) an integrally molded, detachable plug depending from the lower side of the closure and aligned with said aperture;

(d) said plug being fixed in a generally spaced relation with the adjacent lower end of said aperture such that there is provided a gap therebetween for use as a filling passageway through said closure, said plug being sized and shaped for insertion into said aperture to close said seal said container after said container is filled; and (e) said lower closure being telescoped within said container sidewall and having an annular sealing member around the periphery of its upper side in sealing engagement with said container sidewall.

2. The cartridge of claim 1 wherein said plug is attached to said closure by a plurality of detachable vane-like elements.

3. The cartridge of claim 1 wherein said plug includes an upwardly projecting, axially extending flag element and said top wall has an axially extending dispensing outlet through which said element is adapted to project at the uppermost position of said lower closure within the container subsequent to sealing.

4. The cartridge of claim 1 wherein said annular sealing member is cantilevered from the body of said closure and has an interior surface the application of pressure to which causes said sealing member to be biased outwardly.

5. The cartridge of claim 4 wherein an annular coaxial groove extends into the upper side of said closure immediately adjacent said annular sealing member and said outer side of said groove is said interior surface of said sealing member.

6. The cartridge of claim 4 wherein the closure has a central hub and structural support members interconnecting said hub with said cylindrical sidewall to provide rigidity.

7. A generally rigid, disc-shaped, piston-type closure comprising (a) an upper side and a lower side;

(b) an aperture extending axially therethrough;

(c) a cylindrical sidewall;

(d) an annular sealing member around the periphery of said upper side;

(e) an integrally molded, detachable plug depending from said lower side of said closure and aligned with said aperture, said plug being fixed in a generally spaced relation with the adjacent lower end of said aperture such that there is provided a gap therebetween for use as a filling passageway through said closure, said plug being sized and shaped for insertion into said aperture to close and seal said closure.

8. The closure of claim 7 wherein said plug is attached to said closure by a plurality of detachable vane-like elements.

9. The closure of claim 7 wherein said annular sealing member is cantilevered from the body of said closure and has an interior surface the application of pressure to which causes said sealing member to be biased outwardly.

10. The closure of claim 9 wherein an annular coaxial groove extends into the upper side of said closure immediately adjacent said annular sealing member and said outer side of said groove is said interior surface of said sealing member.

11. The closure of claim 9 wherein said closure has a central hub and structural support members interconnecting said hub with said cylindrical sidewall to provide rigidity.

* * * * *

UNITED STATES PATENT OFFICE

CERTIFICATE OF CORRECTION

PATENT NO. : 4,402,427

DATED : September 6, 1983

INVENTOR(S) : Alfred J. Muskovin et al.

It is certified that error appears in the above-identified patent and that said Letters Patent are hereby corrected as shown below:

Column 1, line 19, delete "requirs" and insert therefor --requires--.

Column 3, line 22, after "1979" add --to--.

Column 3, line 31, delete "catridge" and insert therefor --cartridge--.

Column 4, line 42, delete "edge" and insert therefor --edges--.

Column 5, line 49, delete "cartriage" and insert therefor --cartridge--.

Column 6, line 59, delete "16" and insert therefor --10--.

Column 8, line 1, delete "said" (first occurrence) and insert therefor --and--.

Signed and Sealed this

*Twenty-second* Day of *November 1983*

[SEAL]

*Attest:*

GERALD J. MOSSINGHOFF

*Attesting Officer*

*Commissioner of Patents and Trademarks*